US006361889B1

(12) United States Patent
Hill

(10) Patent No.: US 6,361,889 B1
(45) Date of Patent: Mar. 26, 2002

(54) TAMPERPROOF WINDOW SEURABLE INFORMATIONAL ARTICLE

(75) Inventor: Dean Hill, New Freedom, PA (US)

(73) Assignee: Applied Opsec, Inc., Parkton, MD (US)

( * ) Notice: Subject to any disclaimer, the term of this patent is extended or adjusted under 35 U.S.C. 154(b) by 0 days.

(21) Appl. No.: 09/457,172

(22) Filed: Dec. 8, 1999

(51) Int. Cl.[7] ..... B41M 3/12

(52) U.S. Cl. ..... 428/916; 428/201; 428/915; 428/213; 428/914; 428/488.4

(58) Field of Search ..... 428/458, 916, 428/213, 914, 488.4, 500, 204, 207, 201, 915; 156/277, 324

(56) References Cited

U.S. PATENT DOCUMENTS 3,582,439 A * 6/1971 Thomas ..... 161/5
3,864,855 A * 2/1975 Pekko et al. ..... 40/2 R
4,429,015 A 1/1984 Sheptak
4,631,222 A 12/1986 Sander
4,684,795 A * 8/1987 Colgate, Jr. ..... 235/457
4,695,077 A 9/1987 Pretre
4,971,646 A * 11/1990 Schell et al. ..... 156/244.17
5,243,641 A 9/1993 Evans et al.
5,267,753 A 12/1993 Chock
5,370,763 A * 12/1994 Curiel ..... 156/277
5,595,624 A 1/1997 Curiel
5,913,543 A 6/1999 Curiel
5,948,555 A * 9/1999 Curiel ..... 428/914

* cited by examiner

*Primary Examiner*—Merrick Dixon
(74) *Attorney, Agent, or Firm*—David C. Jenkins; Arnold B. Silverman; Eckert Seamans Cherin & Mellott, LLC

(57) ABSTRACT

The tamperproof window securable informational article includes a first side for facing said window and a second side for facing away from said window. A low wet-strength paper layer which will resist removal of said article as a unit when the paper layer has been soaked with a liquid is provided. Standard information and custom information may be interposed between an adhesive layer for securing the article to the window and an optically variable device. A first partially liquid permeable layer is disposed rearwardly of the low wet-strength paper layer. In a preferred embodiment the optically variable device is a hologram and zones of different adhesive and release properties are interposed between the optically variable device and the paper layer to resist removal of the article as a unit.

25 Claims, 2 Drawing Sheets

TAMPERPROOF WINDOW SEURABLE INFORMATIONAL ARTICLE

BACKGROUND OF THE INVENTION

1. Field of the Invention

The present invention relates to a tamperproof window securable informational article which is structured to be adhesively secured to the inner surface of a window such as a vehicle or building window and has means for resisting undesired counterfeiting or removal as a unit.

2. Description of the Prior Art

It has been known for various types of documents, cards and articles that resistance to counterfeiting, as well as tampering with such items has created serious problems. Various means have been known to resist such unauthorized duplication or tampering and alteration.

U.S. Pat. No. 4,429,015 discloses an identification card wherein a laminate contains a photograph, or similar information or indicia, and contains fibers which will be torn if an effort is made to delaminate the card.

It has also been known to embed holograms in such an article so as to resist unauthorized photocopying. U.S. Pat. No. 4,684,795 discloses an identification card, which has a holographic image, embossed in a clear polyethylene containing laminate. The assembly is created under the influence of heat. See also U.S. Pat. No. 4,631,222, which discloses a hot embossing foil, which includes a magnetic layer and a hologram.

U.S. Pat. No. 3,582,439 discloses an identification card which includes vinyl layers between which a photograph and other information is secured in a manner which is said to create a tamper-free structure.

U.S. Pat. No. 4,971,646 discloses a hologram film laminate which contains information overlying the hologram and a metallized layer underlying the same with adhesive being employed to secure the assembly. A clear plastic upper layer is provided.

U.S. Pat. No. 3,864,855 discloses a destructible label system, which includes a tamperproof label. A printable label is said to be fragile such that it cannot be removed from the substrate without destroying the physical integrity of the label base. An adhesive protective film is said to be applied in an overlapping overlay to protect but not support the imprinted surface. Reference is made to the use in connection with a serial number, date and year of manufacture of a vehicle. It has been known to provide holograms on bank documents such as a bank draft in order to resist counterfeiting. See U.S. Pat. No. 5,267,753.

U.S. Pat. No. 4,695,077 discloses a multi-section insurance card, which discloses removal of a protective paper to expose an adhesive to permit folding, trimming and securing a component to the inner surface of an automotive vehicle glass pane.

U.S. Pat. No. 5,370,763 discloses a tamper evident temporary vehicle registration which provides a permanent background grid and enables an auto dealer or other authorized person to handwrite or otherwise apply the specific date of expiration of the temporary tag and then cover the handwritten portion with a write-resistant material thereby resisting counterfeiting or alteration of the dates. See also, U.S. Pat. No. 5,243,641 and 5,595,624.

U.S. Pat. No. 5,913,543 discloses a tamper evident and counterfeit resisting informational article wherein any of a plurality of means may be employed to resist unauthorized reproduction. Among the means employed are holograms including a plurality of generally donut-shaped embossments and hologram particles. It also discloses portions having different adhesion and release properties to facilitate resistance to tampering without permanent changes in the physical structure. The disclosure of this patent is incorporated herein by reference.

In spite of these prior disclosures, there remains a real and substantial need for a window securable informational article, which resists counterfeiting through photocopying or computer scanning and also resists removal of the sticker from the interior of a window as an intact unit.

SUMMARY OF THE INVENTION

The present invention has met the above-described need by providing an informational article having a front side for facing the window to which it will be adhered and a second side for facing away from the window. A low wet-strength paper layer which resists removal of the article as a unit when the paper layer has been soaked with a liquid is provided. A refractory image layer is disposed in front of the low wet-strength paper and a first liquid previous layer is positioned on the second side of the low wet-strength paper. In this manner, a liquid may be applied to the rear surface of the sticker when the window is cleaned without destroying the integrity of the sticker. Efforts to remove the sticker by soaking the same in water, such as, for example, plain or soapy water or other liquid will result in a substantial loss of tensile strength of the low wet-strength paper thereby causing the sticker to fracture responsive to efforts to remove the same.

In a preferred embodiment of the invention, a differential adhesive layer is interposed between the information contained in the article and the optically variable image so as to cause permanent physical changes in the article as a result of an effort to remove the same. Also, the first previous layer may be a first resinous layer which permits moisture to pass through it to the low wet-strength paper, but provides some resistance so as to avoid substantial moisture passing therethrough responsive to mere washing of the interior of the window to which the informational article is secured.

It is an object of the present invention to provide a tamperproof window securable informational article which resists counterfeiting and resists removal of the article from a window to which it is secured without at least substantial destruction thereof.

It is a further object of the present invention to provide such an article wherein efforts to remove the article from the window by soaking the same with a liquid will result in substantial reduction in the strength of the paper layer and thereby cause the article to be destroyed when removal is attempted in this manner.

It is a further object of the present invention to employ the low wet-strength paper as a substantial support for coatings, which will lose their primary basis of support upon destruction of the low wet-strength paper.

It is a further object of the present invention to provide such an article which can be easily removed in a manner which destroys it such that lawful removal at the end of the term for which it serves, can be made without difficulty.

It is a further object of the present invention to provide such an article, which resists transfer of the article as a unit to another vehicle.

It is yet another object of the present invention to provide such a system wherein normal use of a liquid window cleaner will not, in any manner, effect destruction of the informational article.

These and other objects of the invention will be more fully understood from the following description of the invention on reference to the illustrations appended hereto.

DESCRIPTION OF THE PREFERRED EMBODIMENTS

As used herein, "informational article" means an article or portion thereof which is intended to communicate information and will expressly include, but not be limited to, vehicle registration stickers, vehicle inspection stickers, vehicle identification stickers, governmentally issued stickers, parking permits, fleet control stickers, rental car control stickers, tax stamps, and building permits, emergency information stickers, including such items which are secured to or securable to the interior of vehicle or building windows.

As employed herein, the term "vehicle" refers to automobiles, sport utility vehicles, trucks, buses, motorized campers, boats, airplanes, trailers, racing cars, motorcycles, railroad locomotives, and railroad cars.

As employed herein, the term "optically variable device" means a structure which produces a different visual image and/or color change when viewed from different angles and expressly includes, but is not limited to, (a) holograms, (b) surfaces 30 which are embossed or otherwise provided with ridges and troughs, (c) holographic hot stamping foils, (d) chemical coatings, (e) optically variable inks, including thermochromic ultraviolet (UV) reactive, infrared reactive (IR) inks, (f) glass beads, and (g) combinations of the foregoing. The structure may be (1) a diffractive image portion which creates a light interference effect from microscopic slits or grooves as in examples (a), (b), and (c) of this paragraph or (2) a refractive image portion which serves to bend light as it passes through a given material as in examples (d), (e) and (f) of this paragraph or (3) a combination of both diffraction and refraction.

As used herein, the term "low wet-strength paper" means paper which has a substantially reduced tensile strength when soaked with water or other liquids and after one minute retains less than ten percent of its dry tensile strength.

Figure 1:
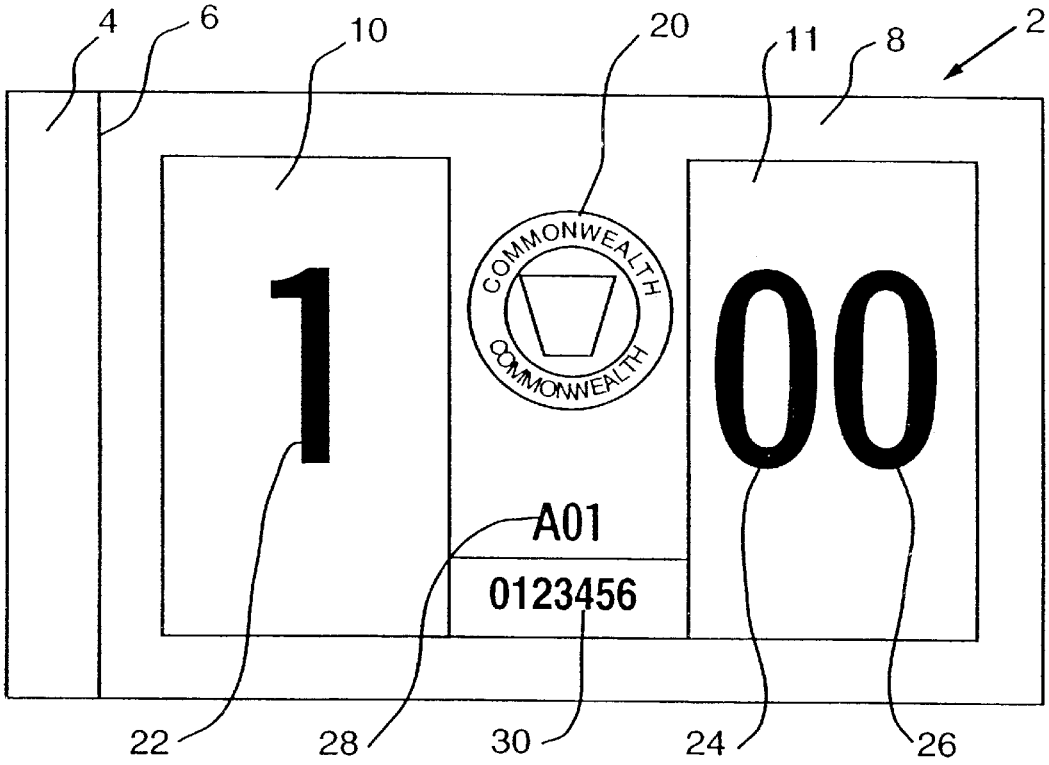
FIG. 1 is a front elevational view of a tamperproof window securable informational article of the present invention.

Referring to FIG. 1 there is shown a front elevational view of a tamperproof window securable informational article of the present invention which has a transparent overlying layer removable by means of a tab portion 4 which is connected to the remainder of the cover by integral hinge portion 6. Lifting of the tab portion 4 and moving it generally to the right of FIG. 1 will expose the underlying pressure sensitive adhesive which then permits the article to be secured to the inner surface of a window. Certain portions of the illustrated article front are preprinted and standard for each unit. For example, this represents a vehicle inspection sticker which has a two-color field with a first color 8 forming a certain predetermined pattern and a second color which is adapted to receive custom information with second color portions 10, 11. Further, an optically variable device which, in the form shown, is a hologram 20 is positioned within the dark colored portion to resist counterfeiting of the article through photocopying. In the event that this were an actual inspection or registration sticker, the number 1 (22) would indicate that the sticker would expire in January and the numbers 00(24,26) would indicate that the year was 2000. All of this foregoing information may be regarded as fixed or standard information which would appear on every article employed in a given time period. Below hologram 20 is custom information, which is different for each sticker. For example, the A01(28) and the seven-digit number 30 may serve to identify a specific vehicle.

It will be appreciated that when the article 2 is secured to the inside of a window, it is important that others not be allowed to visually reproduce the article as by photography, copiers, or computer scanners and thereby counterfeit the same. It is also important that it not be removable intact so as to permit unauthorized transfer to another window.

Figure 2:
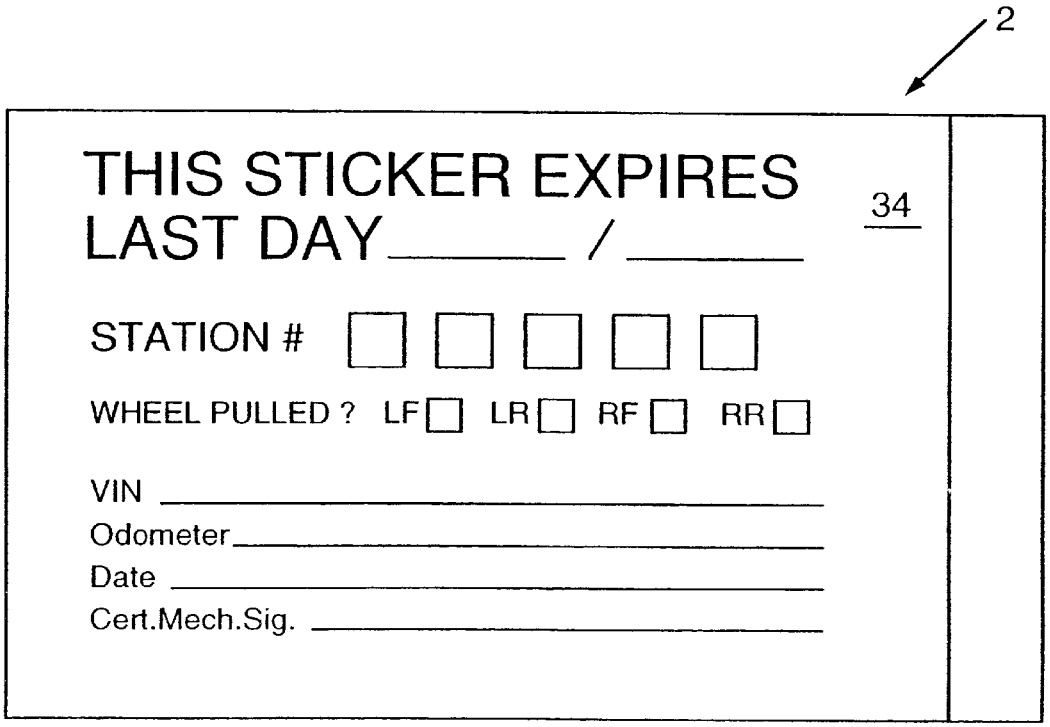
FIG. 2 is a rear elevational view of a form of tamperproof window securable informational article of the present invention.

FIG. 2 shows an embodiment of the rear surface 34 of the sticker or article 2, which contains certain preprinted information relating to vehicle inspection. This information would be fixed or standard information provided on all such articles. The blanks may be completed manually to indicate the date of expiration of the inspection, the station number where an inspection was performed, which wheels were pulled to check brakes and other information including the VIN and odometer numbers, the date, and the signature of the mechanic conducting the inspection.

Figure 3:
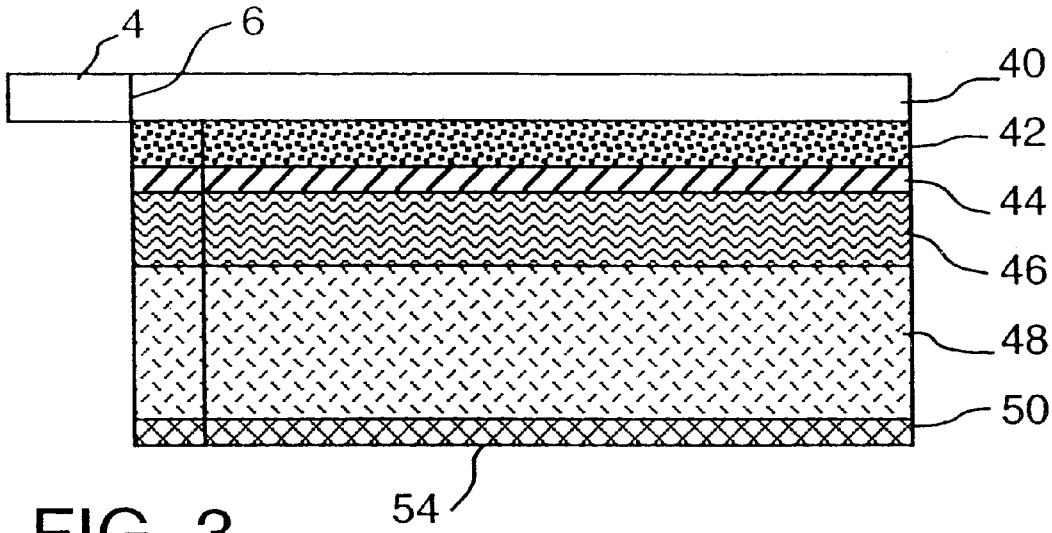
FIG. 3 s a cross-sectional view of an embodiment of a tamperproof window securable informational article of the present invention.

Referring to FIG. 3, a first embodiment of the present invention will be considered. A release liner 40, which is positioned adjacent to what will be the front or window-contacting portion of the article, is provided. The release liner 40 carries the article through the manufacturing process. It may be of the film-type or the Kraft paper-type coated with silicone. It is preferred that it not be completely opaque so that it will permit viewing of the underlying numbers before the sticker is applied to the windshield. The release liner 40 is removably secured to underlying adhesive layer 42, which preferably is a pressure sensitive adhesive layer. The pressure sensitive adhesive is preferably selected based upon the anticipated geographic area and length of service or exposure to sun, which is contemplated. Among the preferred pressure-sensitive adhesives are acrylic pressure-sensitive adhesives as a result of their environmental stability and ultraviolet resistance. Both aqueous based and solvent based acrylic formulations are suitable and may readily be selected by those skilled in the art on the basis of geographic area and factors such as ultraviolet intensity and service life required for the article. For example, if one were to select a vehicle inspection sticker to have a one-year life in Arizona where there would be extremely high ultraviolet exposure, it would be preferable to employ an adhesive with ultraviolet ray absorbers to withstand such exposure. The acrylic pressure-sensitive adhesives also tend to be economical to employ. One suitable such adhesive is that sold under the trade designation #1A14 by Flexcon of Spencer, Mass.

An optically variable device which, in the form shown, is a diffractive layer which includes a metallized layer 44 which makes the diffractive layer reflective and visible and makes the article opaque so that print visible from the front of the sticker does not interfere with back print in sunlight. Such metallization is not required in a chemical refractive layer. The diffractive portion 46 cooperates with the metallic portion 44 to provide such light variations as by micro-embossing gratings or other suitable means. If the refractive layer is not created by micro-embossing, metallizing is not required.

In this embodiment disposed to the rear of the diffractive layer 44, 46 is a low wet-strength paper layer 48 which has reduced tensile strength to lower than ten percent of its original tensile strength when it is soaked with water or soapy water or another liquid thereby resisting removal of the article as a unit. It is preferred that the tensile strength of the paper when soaked in a liquid after one minute will have a strength of less than ten percent of its original dry tensile strength. The original strength may be within the range of about 18 to 42 lbsf/in and be reduced to about 1.04 to 3.15 lbsf/in. wherein "lbsf" means pounds of force per inch. The paper layer preferably has a thickness of about 0.002 to 0.006 inch.

A suitable material for this purpose is K-184 provided by Van Leer Metallized Products of Franklin, Massachusetts and sold under the trade designation K-184 HoloPRISM. Another suitable material offered by the same company is offered under the trade designation K-154. The paper may be a coated two-side publication grade paper.

It is believed that the wet-strength is reduced substantially upon exposure to water, soapy water, oils or other solvents or liquids as a result of the fiber-to-fiber bonds between cellulose fibers being destroyed in an aqueous media. Disposed rearwardly of low wet-strength paper 48 is a first liquid porous ply 50 which is partially previous to liquid and may serve as a calendar which provides a smooth finish to improve the visual quality of print which may be applied to this surface. This coating also serves the important purpose of slowing the absorption of liquids that would break down the strength properties of the low wet-strength paper 48. A feature of this article is that if it is soaked from behind with the intention of softening the adhesive in an attempt to transfer it, the paper will self-destruct. If, however, it is sprayed and wiped during routine window cleaning, it remains intact. This layer 50, which may be applied as a coating, is moisture permeable, yet acts to reduce the rate of absorption of the liquids to allow for cleaning of the inside of the window without damaging the article 2. The rear surface 54 of layer 50 is designed to accept not only printing, but writing from ballpoint pens or other writing implements. The liquid porous ply 50 may be made of any suitable material, such as a paper, paperboard or synthetic resin, which will serve as a partial barrier to passage of liquid therethrough, but not be a total barrier. Among the suitable synthetic materials are film forming resin coatings and elastomeric coatings. It is preferred to select a material from the group consisting of paper, paperboard, acrylics, acetates, vinyls, polyethylenes and urethanes in a thickness of about 0.00005 to 0.0015 inch.

Figure 4:
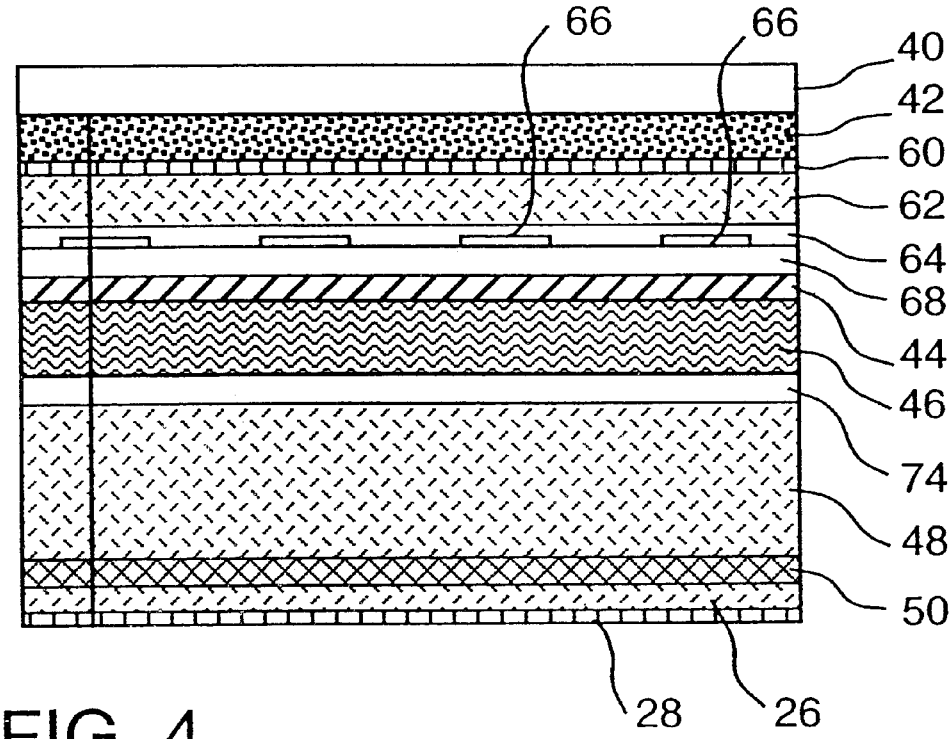
FIG. 4 is a cross-sectional illustration of a preferred embodiment of the window securable informational sticker of the present invention. (The thickness of the layers in FIGS. 3 and 4 are not shown to scale.)

Referring to FIG. 4, a preferred embodiment of the invention will be considered. In this embodiment, the layers of FIG. 3 may be employed with certain additional features being provided. In this embodiment, the custom information 60 will be provided underlying the adhesive 42 which is transparent so as to permit viewing the same. The fixed information 62, which appears on all of the articles, is provided adjacent thereto.

A clear calendar coating 64 which may consist of a transparent water based ink, for example, is positioned with the selected areas having release elements such as 66 which may be of the type disclosed in U.S. Pat. No. 5,913,543, the disclosure of which is incorporated herein by reference. A suitable material is the X-Cell Film Transparent which is available from Water Ink Technologies Inks of Iron Station, N.C. By providing adjacent areas of different relative adhesive characteristics either through adhesive enhancement materials or release coatings or both, any effort to mechanically remove the article from a window will result in fracture of portions of the internal components preferably adjacent to the printed areas 60, 62 so as to resist any effort to conceal the tampering through an effort to reconstruct.

An adhesion enhancing coating 68 which may consist of a water based adhesion promoter, for example, such as Film 3 Primer from Environmental Inks and Coatings, Inc. of Linthicum, Maryland is disposed adjacent to the selective release area 66 and cooperates therewith to provide the desired characteristics.

Layer 74 may be another clear calendar coating, which serves to improve the quality of the refractive layer image.

Referring again to FIG. 2 and to the back portion illustrated in FIG. 4, it will be seen that the fixed printing 76 and custom printing 78 are received on the layer 50.

While it will be appreciated that apart from the optically variable device items 44, 46 and the wet-strength paper 48, as well as the removable release liner 40, which will be provided as discrete lamina, other elements may be provided as a coating. This means that once the wet paper strength has been destroyed or the low wet-strength paper 48 has had its tensile strength destroyed or the selected release 66 or enhanced adhesion portion 68 have been removed, there is little to support the coatings, thereby facilitating destruction.

It be appreciated, therefore, that the present invention provides an economical, effective means for creating a tamperproof window securable informational article which will resist the liquid soaking as a means of unauthorized transfer of the article as a unit while not being destroyed as a result of liquids normally employed in cleaning the window. In addition, means are provided for resisting undesired counterfeiting through copying of the article. All of this eliminates any need to provide any changes in the fixed or custom information or means of applying the same to the article or applying the article to a window.

Whereas particular embodiments of the present invention have been described herein for purposes of illustration, it will be appreciated by those skilled in the art that numerous variations of the details may be made without departing from the invention as described in the appended claims.

I claim:

1. A tamperproof window securable informational article comprising said article having a first side for facing said window and being adhesively bonded thereto and a second side for facing away from said window, a low wet-strength paper layer which will resist removal of said informational article as a unit when said paper layer has been soaked with a liquid, a first adhesive layer for securing said article to said window, an optically variable device disposed on a first side of said paper layer, first information disposed between said optically variable device and said first adhesive layer, a removable release layer secured to said first adhesive layer, and a first liquid porous layer partially previous to liquid disposed on a second side of said paper layer, whereby said paper layer will fracture responsive to soaking in a liquid and applying a force to remove said informational article from said window and said paper layer will not fracture responsive to application of a solution to said first liquid porous layer in an amount adequate to clean said window but inadequate to soak said paper layer.

2. The tamperproof window securable informational article of claim 1 including said optically variable device being a diffractive device.

3. The tamperproof window securable informational article of claim 2 including said diffractive device being a hologram, and said hologram being a metallized hologram.

4. The tamperproof window securable informational article of claim 1 including said article being a vehicle window informational article.

5. The tamperproof window securable informational article of claim 1 including said informational article having a first portion which has information which is standard for said article and a second portion, which is customized for each said article.

6. The tamperproof window securable informational article of claim 5 including said first adhesive layer being a pressure sensitive adhesive.

7. The tamperproof window securable informational article of claim 6 including said first adhesive layer being an ultraviolet light resisting adhesive.

8. The tamperproof window securable informational article of claim 1 including second information provided on the second side of said article.

9. The tamperproof window securable informational article of claim 8 including said second information including standard information and having spaces for insertion of custom information.

10. The tamperproof window securable informational article of claim 1 including said first porous layer being made of material selected from the group consisting of acrylics, paper, paperboard, acetates, vinyls, polyethylenes and urethanes.

11. The tamperproof window securable informational article of claim 10 including said first porous layer having a thickness of about 0.00005 to 0.0015 inch.

12. The tamperproof window securable informational article of claim 11 including said paper layer having a thickness of about 0.002 to 0.006 inch.

13. The tamperproof window securable informational article of claim 8 including said second information being secured to the rear of said paper layer.

14. The tamperproof window securable informational article of claim 1 including a second porous layer interposed between said refractive image layer and said information to resist removal of said article as a unit.

15. The tamperproof window securable informational article of claim 14 including a third porous layer secured to the rear side of said refractive image.

16. The tamperproof window securable informational article of claim 1 including at least one layer disposed between said information and said paper layer being opaque.

17. The tamperproof window securable informational article of claim 2 including said hologram being embossed and metallized.

18. The tamperproof window securable informational article of claim 8 including third information secured to the rear surface of said first porous layer.

19. The tamperproof window securable informational article of claim 18 including said third information including standard information standard for all said articles.

20. The tamperproof window securable informational article of claim 19 including fourth information secured to the rear surface of said first previous layer, which is different for each article.

21. The tamperproof window securable informational article of claim 1 including said article being a governmentally issued vehicle window securable informational article.

22. The tamperproof window securable informational article of claim 1 including said first liquid porous layer being composed of a resinous material.

23. The tamperproof window securable informational article of claim 1 including said article having regions of differential adhesion interposed between said optically variable device and said first information, whereby efforts to remove the article from a window to which it is adhered will result in irreversible physical changes in said informational article.

24. The tamperproof window securable informational article of claim 1 including said optically variable device being a refractive device.

25. The tamperproof window securable informational article of claim 1 including said optically variable device having both a diffractive device and a partially refractive device.

* * * * *

UNITED STATES PATENT AND TRADEMARK OFFICE

CERTIFICATE OF CORRECTION

PATENT NO. : 6,361,889 B1
DATED : March 26, 2002
INVENTOR(S) : Dean Hill

It is certified that error appears in the above-identified patent and that said Letters Patent is hereby corrected as shown below:

Title page, Item [54] and Column 1, line 1,
Title, "SEURABLE" should read -- SECURABLE --.

Column 3,
Line 40, remove "30" after "surfaces".

Column 5,
Line 30, "previous" should read -- pervious --.

Signed and Sealed this

Second Day of July, 2002

*Attest:*

*Attesting Officer*

JAMES E. ROGAN
*Director of the United States Patent and Trademark Office*